United States Patent [19]

Schmid et al.

[11] Patent Number: 5,057,247

[45] Date of Patent: Oct. 15, 1991

[54] HIGH-VISCOSITY, NEUTRAL POLYOL ESTERS

[75] Inventors: Karl-Heinz Schmid, Mettmann; Uwe Ploog, Haan; Alfred Meffert, Monheim, all of Fed. Rep. of Germany

[73] Assignee: Henkel Kommanditgesellschaft auf Aktien, Duesseldorf-Holthausen, Fed. Rep. of Germany

[21] Appl. No.: 136,037

[22] Filed: Dec. 21, 1987

[30] Foreign Application Priority Data

Dec. 22, 1986 [DE] Fed. Rep. of Germany ..... 3643935

[51] Int. Cl.[5] ..... C10M 105/42; C10M 129/78

[52] U.S. Cl. ..... 252/56 S; 252/56 R; 252/56 D; 560/199

[58] Field of Search ..... 525/501, 52 R, 565, 525/56 R; 260/398, 410, 410.6; 560/199

[56] References Cited

U.S. PATENT DOCUMENTS

| | | | |
|---|---|---|---|
| 3,000,917 | 9/1961 | Babayan | 560/199 |
| 3,708,522 | 1/1973 | LeSuer | 560/199 |
| 3,753,968 | 8/1973 | Ward | 260/97.6 |
| 4,049,563 | 9/1977 | Burrous | 252/56 S |
| 4,201,809 | 5/1980 | Ogawa | 252/56 R |
| 4,277,417 | 7/1981 | Varma | 252/48.2 |
| 4,477,383 | 10/1984 | Beimesch | 252/56 S |
| 4,589,900 | 5/1986 | Zehler | 252/56 S |
| 4,589,990 | 5/1986 | Zehler | 252/56 S |
| 4,645,615 | 2/1987 | Drake | 252/56 S |

FOREIGN PATENT DOCUMENTS

| | | | |
|---|---|---|---|
| 1016539 | 8/1977 | Canada . | |
| 0006350 | 1/1978 | Japan | 252/56 R |
| 56-51433 | 5/1981 | Japan | 560/199 |
| 0739083 | 6/1980 | U.S.S.R. | 252/56 R |
| 644597 | 10/1950 | United Kingdom | 560/199 |
| 663566 | 12/1951 | United Kingdom | 560/199 |
| 971901 | 10/1964 | United Kingdom | 560/199 |
| 1122466 | 8/1968 | United Kingdom | 560/199 |

*Primary Examiner*—Prince E. Willis
*Assistant Examiner*—Ellen McAvoy
*Attorney, Agent, or Firm*—Ernest G. Szoke; Wayne C. Jaeschke; Henry E. Millson, Jr.

[57] ABSTRACT

Synthetic polyol esters with lubricating oil properties based on substantially neutral esterification products of a polyhydric alcohol with selected monocarboxylic acids and, optionally, polybasic carboxylic acids, wherein the polyfunctional alcohol component is dipentaerythritol which is esterified with I—branched $C_8$–$C_{16}$ fatty acids (class A acids) or with II—mixtures of linear $C_8$–$C_{14}$ fatty acids (class B acids) with branched fatty acids of class A and, optionally, limited quantities of polybasic carboxylic acids of the following classes C, D and/or E incorporated in the polyester molecular by condensation:

class C acids: di- and/or tricarboxylic acids in the range from $C_6$ to $C_{54}$ class D acids: difunctional fatty acids which have been obtained by addition of acrylic acid onto the double bonds of oleic acid, linoleic acid and/or linolenic acid class E acids: aromatic and/or paraffinic, cyclic polycarboxylic acids containing from 2 to 6 acid functions.

20 Claims, No Drawings

HIGH-VISCOSITY, NEUTRAL POLYOL ESTERS

BACKGROUND OF THE INVENTION

1. Field of the Invention

This invention relates to new synthetic polyol esters particularly useful as temperature-stable lubricating oils.

2. Statement of Related Art

In recent years, synthetic esters, so-called ester oils, have acquired increasing importance as high-quality lubricating oils. For example, diesters of dibasic carboxylic acids with monohydric alcohols, for example dioctyl sebacate, and also esters of polyols with monobasic acids, such as trimethylolpropane tripelargonate, have been proposed as lubricants for aircraft turbines. The polyols used here are, for example, trimethylolpropane, neopentyl glycol and/or pentaerythritol.

The eminent suitability of synthetic esters as lubricants derives from the fact that they show more favorable viscosity temperature behavior than conventional lubricating oils based on mineral oils and from the fact that, where comparable viscosities are adjusted, the pour points are distinctly lower.

Nevertheless, there is still considerable interest in new synthetic ester components which combine a low pour point with high viscosity, good viscosity temperature behavior, high temperature resistance, a high flash point, and minimal losses through evaporation at high temperatures.

DESCRIPTION OF THE INVENTION

Other than in the operating examples, or where otherwise indicated, all numbers expressing quantities of ingredients or reaction conditions used herein are to be understood as modified in all instances by the term "about".

The present invention seeks to solve the problem of providing new synthetic polyol esters which are particularly suitable for the use in the field of temperature-stable lubricating oils, such as transmission and hydraulic oils, and in lubricating oil dispersions and lubricating greases and which, at the same time, can be optimally adapted to the selection criteria discussed above.

According to the invention, the solution to this problem is based on the choice of a certain polyol component as the hydroxyl group component for the production of the polyol esters and combines this choice of the hydroxyl group component with the choice of certain mono- and, optionally, polybasic carboxylic acids as the acid component for the production of the new synthetic polyol esters.

In a first embodiment, therefore, the present invention relates to synthetic polyol esters with lubricating oil properties based on substantially neutral esterification products of a polyhydric alcohol with selected monocarboxylic acids and, if desired, polybasic carboxylic acids. In this embodiment, the polyhydric alcohol component is dipentaerythritol which is esterified with I—branched $C_8$–$C_{16}$ fatty acids (class A acids) or with II—mixtures of linear $C_8$–$C_{14}$ fatty acids (class B acids) in admixture with branched class A fatty acids and, if desired, additionally contains limited quantities of polybasic carboxylic acids of the following classes C, D and/or E incorporated in the polyester molecule by condensation:

class C acids: di- and/or tricarboxylic acids in the range from $C_6$ to $C_{54}$ class D acids: difunctional fatty acids which have been obtained by addition of acrylic acid to the double bonds of oleic acid, linoleic acid and/or linolenic acid class E acids: aromatic and/or cyclo paraffinic polycarboxylic acids containing from 2 to 6 acid functions.

In another embodiment, the invention relates to the use of the new synthetic polyol esters for the production of temperature-stable transmission and hydraulic oils and of lubricating oil dispersions and/or lubricating greases.

Besides the choice of dipentaerythritol in accordance with the invention as the central polyol component for the production of the new synthetic polyol esters according to the invention, the choice of the monobasic carboxylic acid components used for esterification and the polybasic carboxylic acid components optionally used in small quantities is of crucial importance. The fatty acids used for esterification can be divided up into classes A to E listed below, the fatty acid classes A and B comprising monocarboxylic acids while the acid classes C, D and E comprise higher carboxylic acids. More specifically, the following particulars apply to the various acid classes:

class A acids: branched $C_8$–$C_{16}$ fatty acids class B acids: linear $C_8$–$C_{14}$ and preferably $C_8$–$C_{10}$ fatty acids.

The new synthetic polyol esters according to the invention can contain exclusively branched fatty acids from class A or mixtures of branched fatty acids from class A with linear fatty acids from class B as the fatty acid component. Particulars of the preferred mixing ratios are given below.

The polybasic carboxylic acids which can be used together with the branched fatty acids (class A) or mixtures of branched and linear fatty acids (classes A+B) can be placed in the following classes:

Acids of class C: $C_6$–$C_{54}$ di- and/or tricarboxylic acids. Adipic acid, trimethyl adipic acid, azelaic acid and/or sebacic acid are particularly preferred. Other suitable and particularly preferred polybasic acids of this class are di- and trimer fatty acids from the polymerization of mono- and/or polyunsaturated $C_{16}$–$C_{22}$ fatty acids.

Acids of class D: difunctional fatty acids obtained by addition of acrylic acids to the double bonds of oleic acid, linoleic acid and/or linolenic acid. Corresponding addition products with mixtures of these three unsaturated acids are particularly suitable. The production of these difunctional acids of class D is described, for example, in CA 1,016,539 and U.S. Pat. No. 3,753,968.

Acids of class E: aromatic and/or cyclo paraffinic polycarboxylic acids containing from 2 to 6 acid functions. Particularly preferred acids of this type are terephthalic acid, trimellitic acid, pyromellitic acid and/or cyclohexane dicarboxylic acid which may be used either as such or in the form of their anhydrides for the production of the new synthetic polyol esters.

Synthetic polyol esters of the invention of the type described above correspond to the following definitions with respect to the quantities of polyol ester-forming reactants and particularly with respect to the carboxylic acid components used, the equivalents of acid components indicated below totalling 6 equivalents and being based in each case on 1 mole of dipentaerythritol, i.e. 6 hydroxyl equivalents:

1. 6 equivalents of one or more class A fatty acids
2. mixtures of 1 to 4 equivalents of branched class A fatty acids and 2 to 5 equivalents of linear class B fatty acids
3. 4 to 5.8 equivalents of a mixture of the acids according to I above (class A fatty acids) with 0.2 to 2 equivalents of class C and/or class D and/or class E fatty acids and
4. 4 to 5.8 equivalents of a mixture according to II above (mixture of class A and class B fatty acids) with 0.2 to 2 equivalents of class C and/or class D and/or class E fatty acids.

According to the invention, synthetic polyol esters of the above-described type having low acid numbers are preferred, neutral esters or those containing a limited excess of free hydroxyl groups being particularly preferred.

In one particularly preferred embodiment of the invention, from 6.0 to 7.2 equivalents (corresponding to 1 to 1.2 moles) of dipentaerythritol are used for each 6 equivalents of the acids or acid mixtures used in the production of the esters. Preferred polyol esters of this type have hydroxyl numbers of from 0 to 25.

In addition, preferred esters according to the invention have viscosities at 40° C. of from 50 to 1000 $mm^2/s$ and pour points of from 0° to −30° C.

Where branched fatty acids (class A acids) are exclusively used and particularly where 2-ethyl hexanoic acid, isononanoic acid, isodecanoic acid and/or isotridecanoic acid are used, esters having ISO VG viscosities of from 320 to 460 (as defined in ISO 3448 or DIN 51 519) are obtained.

Through the co-use of linear fatty acids, the viscosity of the polyol esters produced is reduced to a value of from ISO VG 46 to ISO VG 220. If it is desired to increase the viscosity of the esters, it is essential to co-use dibasic and polybasic acids from classes C, D and/or E given above.

By virtue of their high thermal stability, their minimal evaporation losses at 250° C. and higher and their flash points of around 300° C., the new polyol esters according to the invention are suitable carrier oils for temperature-stable lubricating oil dispersions and lubricating greases and, in addition, can also be used as added components or sole component in hydraulic and transmission oils by virtue of their favorable tribological properties, for example their excellent pressure absorbing capacity. Standard additives, such as oxidation and corrosion inhibitors, dispersants, high-pressure additives, foam inhibitors, metal deactivators and other additives, may be added in their usual active quantities.

The invention will be illustrated but not limited by the following examples.

EXAMPLES

General Procedure for the Production of the Polyesters

Procedure

Dipentaerythritol and the selected fatty acid mixture are esterified for 6 to 8 hours at 240° C. in the presence of 0.5% tin powder, the water formed during the reaction being distilled off. Toward the end of the reaction, esterification is continued at the same temperature, but at a reduced pressure. After cooling to 120° C., 1% by weight activated fuller's earth is added, the mixture reheated to 200° C. and excess monocarboxylic acid distilled off in vacuo. After cooling, the reaction mixture is filtered.

| Example no. | Dipentaerythritol (equivalents) | Fatty acids (equivalents) | Pour Point °C. | Viscosity $mm^2/s$ at 40° C. |
|---|---|---|---|---|
| 1 | 6.4 | 6.2 isononanoic acid | −20° C. | 361 |
| 2 | 6.4 | 1.0 isononanoic acid<br>5.1 caprylic acid | −15° C. | 84 |
| 3 | 6.4 | 1.0 isononanoic acid<br>4.1 caprylic acid<br>1.0 trimellitic acid | −8° C. | 827 |
| 4 | 6.4 | 1.0 isononanoic acid<br>4.5 caprylic acid<br>0.6 dimer fatty acid (molecular weight 580) | −20° C. | 383 |
| 5 | 6.4 | 3.5 isononanoic acid<br>1.1 caprylic acid<br>1.1 capric acid<br>0.4 dimer fatty acid (molecular weight 580) | −30° C. | 440 |

Further particulars of the properties of the polyol esters of Examples 1 and 5 are summarized in the following.

EXAMPLE 1

| | | |
|---|---|---|
| Kinematic viscosity | at 20° C. | approx. 1816 $mm^2/s$ |
| | at 40° C. | approx. 361 $mm^2/s$ |
| | at 100° C. | approx. 25 $mm^2/s$ |
| Viscosity index | | approx. 90 |
| Thermogravimetric analysis (loss of substance on continuous heating at 20° C. per minute) | at 200° C. | 0% |
| | at 250° C. | 0% |
| | at 300° C. | 2% |
| Wear characteristics | | |
| (a) Shell four-ball apparatus (DIN 51 350, Part 3) cup diameter under load (450 N): 0.6 mm | | |
| (b) Optimol "SRV apparatus" maximal load uptake at 50° C.: 400 N | | |
| friction value under load (200 N/50° C.): | | |
| min. 0.115 | | |
| max. 0.130 | | |

Thermogravimetric analysis (volatility)

The temperature/weight analysis indicates the loss of substance in percent which occurs on continuous heating at a rate of 20° C. per minute.

EXAMPLE 5

| | | |
|---|---|---|
| Kinematic viscosity | at 20° C. | approx. 1800 $mm^2/s$ |
| | at 40° C. | approx. 440 $mm^2/s$ |

-continued

| | | |
|---|---|---|
| | at 100° C. | approx. 35 $mm^2/s$ |
| Viscosity index | | approx. 120 |
| Pour point | | approx. −30° C. |
| Thermogravimetric analysis | at 200° C. | 0% |
| (loss of substance on | at 250° C. | 0% |
| continuous heating at | at 300° C. | 1% |
| 20° C. per minute) | | |
| Flash point (DIN ISO 2592) | | approx. 300° C. |
| Wear characteristics | | |
| (a) Shell four-ball apparatus | | |
| VKA welding force (DIN 51 350, Part 2) | | |
| approx. 1500 N | | |
| cup diameter (DIN 51 350, Part 3) | | |
| approx. 1.05 mm under 600 N load | | |
| (b) Optimol "SRV apparatus" | | |
| welding force: approx. 400 N at 100° C. | | |
| friction coefficient (μ) at 100° C./100 N | | |
| min.: approx. 0.105 | | |
| max.: approx. 0.129 | | |

SRV Method

R. Schumann, ant. "Antriebstechnik" 19 (1980) no. 1-2.

We claim:

1. In a lubricating oil, lubricating oil dispersion, or lubricating grease containing a carrier oil component the improvement comprising the presence therein of a temperature stabilizing quantity of a synthetic polyol ester comprising the esterification product of:

I. dipentaerythritol;
  and based on each 6 hydroxyl equivalents of component I, II. from about 4 to about 5.8 equivalents of either
  A. at least one saturated branched $C_8$–$C_{16}$ fatty acid, or
  B. a mixture of at least one saturated branched $C_8$–$C_{16}$ fatty acid and at least one saturated linear $C_8$–$C_{14}$ fatty acid, wherein from about 1 to about 4 equivalents of branched $C_8$–$C_{16}$ fatty acid and from about 2 to about 5 equivalents of linear $C_8$–$C_{14}$ fatty acid is present in the mixture; and III. from about 0.2 to about 2 equivalents of at least one compound selected from the group consisting of
  A. a $C_6$–$C_{14}$ di- or tri-carboxylic acid; and
  B. an aromatic or cycloparaffinic polycarboxylic acid containing from 2 to 6 acid functions.

2. The lubricating oil, lubricating oil dispersion, or lubricating grease of claim 1 wherein component III of the synthetic polyol ester is at least one compound selected from the group consisting of adipic acid, trimethyl adipic acid, azelaic acid, sebacic acid, a dimer fatty acid from the polymerization of a monounsaturated $C_{16}$–$C_{22}$ fatty acid, a dimer fatty acid from the polymerization of a polyunsaturated $C_{16}$–$C_{22}$ fatty acid, a trimer fatty acid from the polymerization of a monounsaturated $C_{16}$–$C_{22}$ fatty acid, a trimer fatty acid from the polymerization of a polyunsaturated $C_{16}$–$C_{22}$ fatty acid, terephthalic acid, trimellitic acid, pyromellitic acid, cyclohexane dicarboxylic acid, and an anhydride of any of the four foregoing acids.

3. The lubricating oil, lubricating oil dispersion or lubricating grease of claim 1 wherein the synthetic polyol ester is a substantially neutral esterification product.

4. The lubricating oil, lubricating oil dispersion, or lubricating grease of claim 1 wherein the ester has a free OH number of from 0 to about 25.

5. The lubricating oil, lubricating oil dispersion, or lubricating grease of claim 1 wherein in the ester from about 6.0 to about 7.2 equivalents of component I are present per each 6 equivalents of components II plus III.

6. The lubricating oil, lubricating oil dispersion, or lubricating grease of claim 1 wherein the ester has a viscosity value at 40° C. of from 50 to 1000 $mm^2/s$ and a pour point of from 0° C. to -30° C.

7. The lubricating oil, lubricating oil dispersion or lubricating grease of claim 1 wherein in component II b of the ester the at least one linear $C_8$–$C_{14}$ fatty acid contains from 8 to 10 carbon atoms.

8. The lubricating oil, lubricating oil dispersion, or lubricating grease of claim 1 wherein the synthetic polyol ester comprises the esterification product of components I, IIB, and IIIA.

9. The lubricating oil, lubricating oil dispersion, or lubricating grease of claim 1 wherein the synthetic polyol ester comprises the esterification product of components I, IIB, and IIIB.

10. The lubricating oil, lubricating oil dispersion, or lubricating grease of claim 1 wherein the synthetic polyol ester is the only carrier oil component present in the lubricating composition.

11. A process for increasing the temperature stability of a lubricating oil, lubricating oil dispersion, or lubricating grease containing a carrier oil component comprising adding thereto a temperature stabilizing quantity of a synthetic polyol ester comprising the esterification product of:

I. dipentaerythritol; and based on each 6 hydroxyl equivalents of component I,

II. from about 4 to about 5.8 equivalents of either
  A. at least one saturated branched $C_8$–$C_{16}$ fatty acid, or
  B. a mixture of at least one saturated branched $C_8$–$C_{16}$ fatty acid and at least one saturated linear $C_8$–$C_{14}$ fatty acid, and III. from about 0.2 to about 2 equivalents of at least one compound selected from the group consisting of
  A. a $C_6$–$C_{54}$ di- or tri-carboxylic acid; and
  B. an aromatic or cycloparaffinic polycarboxylic acid containing from 2 to 6 acid functions.

12. The process of claim 11 wherein the synthetic polyol ester comprises the esterification product of components I, IIB, and IIIA.

13. The process of claim 11 wherein the synthetic polyol ester comprises the esterification product of components I, IIB, and IIIB.

14. The process of claim 11 wherein the synthetic polyol ester is the only carrier oil component present in the lubricating composition.

15. The process of claim 11 wherein component III of the ester is at least one compound selected from the group consisting of: adipic acid, trimethyl adipic acid, azelaic acid, sebacic acid, a dimer fatty acid from the polymerization of a monounsaturated $C_{16}$–$C_{22}$ fatty acid, a dimer fatty acid from the polymerization of a polyunsaturated $C_{16}$–$C_{22}$ fatty acid, a trimer fatty acid from the polymerization of a monounsaturated $C_{16}$–$C_{22}$ fatty acid, a trimer fatty acid from the polymerization of a polyunsaturated $C_{16}$–$C_{22}$ fatty acid, terephthalic acid, trimellitic acid, pyromellitic acid, cyclohexane dicarboxylic acid, and an anhydride of any of the four foregoing acids.

16. The process of claim 11 wherein the ester is a substantially neutral esterification product.

17. The process of claim 11 wherein the ester has a free OH number of from 0 to about 25.

18. The process of claim 11 wherein from about 6.0 to about 7.2 equivalents of component I are present per each 6 equivalents of components II plus III.

19. The process of claim 11 wherein the ester has a viscosity value at 40° C. of from 50 to 1000 $mm^2/s$ and a pour point of from 0° to −30° C.

20. The process of claim 11 wherein in component II b of the ester the at least one linear $C_8$–$C_{14}$ fatty acid contains from 8 to 10 carbon atoms.

* * * * *